US005199716A

United States Patent [19]

DeFluiter et al.

[11] Patent Number: 5,199,716

[45] Date of Patent: Apr. 6, 1993

[54] SUCTION BALL

[76] Inventors: David DeFluiter; Darren DeFluiter, both of 169 W. Alessandro, San Clemente, Calif. 92672

[21] Appl. No.: 746,948

[22] Filed: Aug. 19, 1991

[51] Int. Cl.[5] ..... A63B 43/00

[52] U.S. Cl. ..... 273/344; 273/58 K

[58] Field of Search ..... 273/344, 58 K

[56] References Cited

U.S. PATENT DOCUMENTS

| | | | |
|---|---|---|---|
| 2,187,524 | 1/1940 | Price | 273/344 |
| 2,745,666 | 5/1956 | Swartz | 273/412 X |
| 3,378,260 | 4/1968 | Hartel | 273/344 |
| 4,516,774 | 5/1985 | Nankivell | 273/67 B |
| 5,066,018 | 11/1991 | Hinton | 273/344 |

*Primary Examiner*—William H. Grieb

*Attorney, Agent, or Firm*—Beech & Collins

[57] ABSTRACT

A ball or sphere which has suction cups distributed around its outside surface and is of a size that it can be handled and thrown in the air by hand. Generally, a ball of baseball size has been found to be the preferred size. The ball can be thrown in the air against a smooth, nonporous surface and attaches to the surface by the force of suction.

The suction ball works well in adverse environments such as water in water sports and is useful for improving coordination and motor skills in throwing objects. When used in conjunction with a hand held catching surface, the suction ball can be caught by swinging the hand at the approaching ball. The ball and catching surface are particularly useful for persons who are unable to throw and catch a conventional ball.

1 Claim, 1 Drawing Sheet

SUCTION BALL

FIELD OF THE INVENTION

This invention relates to objects which can be thrown and caught and are generally used in games. The new device incorporates a plurality of suction cup devices spaced around the surface of a sphere to allow the sphere or ball to stick to a surface.

DESCRIPTION OF RELATED ART

Currently in use are many versions of spherical objects or balls which can be thrown, hit, batted by hand or by other means manipulated. Various types of balls have been around for centuries.

In the area related to the instant device the art concerns balls that can be thrown in the air to be caught or retrieved prior to hitting the ground. A similar object in this category is for example a baseball. The baseball is designed to be thrown or hit and then to be caught normally by a glove, but also may be caught bare handed by a person. The baseball may also hit the ground prior to being caught.

The present invention is a ball to be thrown in the air that has suction cups distributed around its surface. The suction cup distribution is such that when the ball strikes a nonporous, smooth surface it adheres or sticks to that surface. This added feature allows the ball to be caught with a flat or slightly curved paddle or disk rather than the need for a glove or hand closing or a net of some sort. The suction ball can be caught by swinging or slapping at it with a paddle or disk held in the hand. The suction ball configuration works well around the water.

SUMMARY OF THE INVENTION

A primary objective of the present invention is to provide a device that can be thrown like a ball, such as a baseball, that will adhere to a smooth, nonporous surface. A further objective is to provide a device for catching the suction ball while it is airborne. The suction ball is useful for developing coordination and works well in environments such as water sports.

In accordance with the description presented herein, other objects of this invention will become apparent when the description and drawings are reviewed.

DESCRIPTION OF THE PREFERRED EMBODIMENT

The suction ball consists of a sphere or ball with suction cups spaced around its surface at relatively equal distances from adjacent suction cups. The suction cups are raised slightly from the surface on short pedestals formed with the suction cup. A smooth, nonporous device can be used to catch the ball as the suction cups adhere to the surface. The ball may be thrown against any smooth, nonporous surface allowing the suction cups to hold the ball to the surface.

Figure 1:
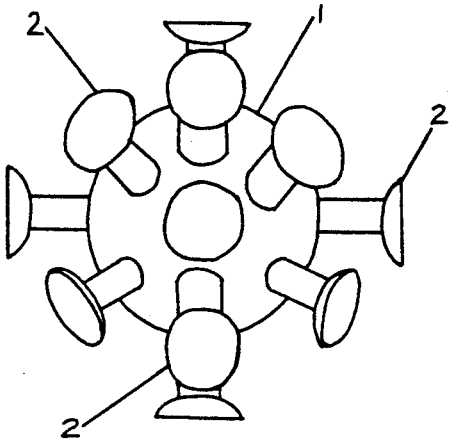
FIG. 1 illustrates the ball with suction cups attached.
Figure 2:
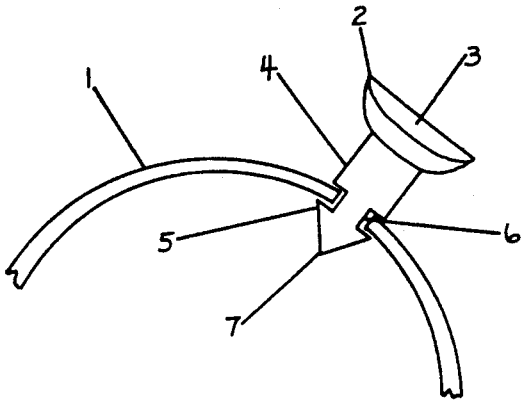
FIG. 2 illustrates a cross section view of a suction cup attached to the ball.

Referring to FIGS. 1 and 2, the suction ball is a sphere (1) with suction cups (2) spaced around the surface of the sphere (1). The suction cups (2) are spaced such that adjacent cups are relatively at equal distances from each other. This spacing is determined from the size of the cup (3) to provide suction cup (2) coverage around the surface of the sphere.

The suction cup (2) is normally formed of one piece of soft plastic with a cup (3) on a pedestal (4) having a connector (5) end. The suction cup (2) is pliable enough to allow the cup (3) to form to a surface and hold the suction ball by suction force on the surface. The suction cup (2) is also hard enough to allow the connector (5) to be retained in an aperture (6) in the sphere (1).

A configuration of the suction ball that has been found to work well is a hollow sphere (1) of one and one half inch diameter formed of two half spheres glued together. The sphere (1) has 20 apertures arranged approximately such that 8 apertures (6) are equidistant from adjacent apertures (6) around the surface of the sphere (1) on a circle of the sphere (1) in the same plane. An aperture (6) is then located on each point perpendicular to that plane on the surface of the sphere (1) on an axis through the center of the sphere (1). Finally on each half surface of the sphere (1), 5 apertures (6) are located approximately equidistant around and from each half of the two apertures (6) on the perpendicular to the plane and the 8 apertures (6) located in the plane.

The dimensions for the elements of this 20 suction cup (2) suction ball are: the hollow sphere (1) is approximately 1½ inches in diameter as earlier stated; the suction cups (2) are approximately ¾ inches long with the diameter of the cup (3) approximately ¾ inches in diameter. This makes the pedestal (4) approximately ¼ inch and the connector (5) ¼ inch in length. The cup (3), pedestal (4) and connector (5) are all round with relative diameter as shown in FIG. 2.

The connector (5) end of the suction cup (2) tapers to a point (7) for insertion in the apertures (6) and the connector (5) has a smaller diameter section relative to the diameter of the pedestal (4) and the point (7) end taper.

Figure 3:
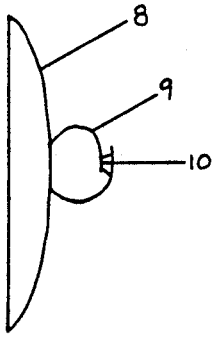
FIG. 3 illustrates a side view of a disk or disk shaped catching device with a hand strap.
Figure 4:
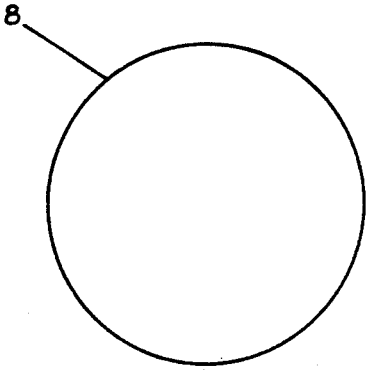
FIG. 4 illustrates a front view of the disk.

The suction ball may be thrown against any smooth, nonporous surface to be held by the suction force. A paddle or disk of plastic or other suitable substance may also be used to stop or catch a thrown suction ball. Referring to FIGS. 3 and 4, a disk (8) with a slight concave curvature has a hand strap (9) with VELCRO or other means of connection (10) such that a person can hold the disk (8) with one hand. The hand strap (9) may be attached to the back of the disk (8) or passed through two slits made in the disk (8). A handle may also be glued to the back or formed as part of a plastic disk (8) for holding the disk (8).

The disk (8) is circular and at least twice the diameter of the suction ball it is intended to be used with. An eight inch diameter disk has been found to work well. Other configurations may be used for catching the ball such as a rectangular disk shape or a disk with a handle attached. In addition, flat surfaces may also be used. However, a concave disk (8) gives some protection such that the smooth surface isn't scratched when placed on another surface.

Other configurations of sphere (1) and suction cup (2) size and location are also possible. A minimum of six suction cups (2) placed on the surface of the sphere (1) at the points where a three dimensional perpendicular set of axis penetrate the sphere surface is such a combination. Also a large number of much smaller suction cups (2) on a sphere (1) is an alternate combination. In the preferred configuration of sphere (1) and suction cup (2) sizes the number of suction cups (2) for best results is 18 to 24.

I claim:

1. A device for throwing and adhering to a surface comprising:

a. a sphere which is hollow and formed from two half spheres connected together which is approximately 1½ inches in diameter;

b. the sphere has 18 to 24 apertures defined therein with each aperture spaced equidistant from adjacent apertures spaced around the sphere surface;

c. wherein 18 to 24 round suction cups comprised of a cup, a pedestal and a connector are inserted and retained in the apertures; and d. the suction cup is approximately ¾ inches long with the cup ¾ inches in diameter, the pedestal is approximately ¼ inch long and smaller in diameter than the cup, and the connector is approximately ¼ inch long having an end tapered to a point and a section smaller in diameter than the pedestal.

* * * * *